US011284184B2

(12) United States Patent
Fellers et al.

(10) Patent No.: US 11,284,184 B2
(45) Date of Patent: Mar. 22, 2022

(54) AUTO CALIBRATION OF AN ACTIVE NOISE CONTROL SYSTEM

(71) Applicant: Dolby Laboratories Licensing Corporation, San Francisco, CA (US)

(72) Inventors: Matthew Conrad Fellers, San Francisco, CA (US); Louis D. Fielder, Millbrae, CA (US); Douglas Walter Hansen, Dublin, CA (US); Joshua B. Lando, Mill Valley, CA (US); C. Phillip Brown, Castro Valley, CA (US); Rhonda J. Wilson, San Francisco, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 17/265,485

(22) PCT Filed: Jul. 29, 2019

(86) PCT No.: PCT/US2019/043993
§ 371 (c)(1),
(2) Date: Feb. 2, 2021

(87) PCT Pub. No.: WO2020/028280
PCT Pub. Date: Feb. 6, 2020

(65) Prior Publication Data

US 2021/0204054 A1 Jul. 1, 2021

Related U.S. Application Data

(60) Provisional application No. 62/857,751, filed on Jun. 5, 2019, provisional application No. 62/713,643, filed on Aug. 2, 2018.

(51) Int. Cl.
*G10K 11/178* (2006.01)
*H04R 1/10* (2006.01)
*H04R 29/00* (2006.01)

(52) U.S. Cl.
CPC ..... *H04R 1/1083* (2013.01); *G10K 11/17875* (2018.01); *G10K 11/17885* (2018.01);
(Continued)

(58) Field of Classification Search
CPC ..... G10K 11/17875; G10K 11/17885
See application file for complete search history.

(56) References Cited

U.S. PATENT DOCUMENTS 5,440,642 A 8/1995 Denenberg
6,532,296 B1 3/2003 Vaudrey
(Continued)

FOREIGN PATENT DOCUMENTS

CN 105593927 B 11/2019
CN 106664473 B 2/2020
(Continued)

OTHER PUBLICATIONS

Zhang, Y. et al "A Multi-Frequency Multi-Standard Wideband Fractional-N PLL with Adaptive Phase-Noise Cancellation for Low-Power Short-Range Standards" Apr. 2016, IEEE Transactions on Microwave Theory and Techniques, v. 64, No. 4, pp. 1133-1142.

*Primary Examiner* — Ping Lee

(57) ABSTRACT

A method of calibrating a feedback-based noise cancellation system of an ear device may involve obtaining a measured plant response of the ear device, obtaining a reference plant response value and determining a plant response variation between the reference plant response value and a value corresponding to the measured plant response. The method may involve obtaining a measured a coupler response of the ear device, obtaining a reference coupler response value and
(Continued)

determining a coupler response variation between the reference coupler response value and a value corresponding to the measured coupler response. The method may involve determining, based at least in part on the plant response variation and the coupler response variation, a microphone signal gain correction factor and applying the microphone signal gain correction factor to ear device microphone signals that are input to a feedback loop of the feedback-based noise cancellation system.

11 Claims, 5 Drawing Sheets

(52) U.S. Cl.
CPC ..... *H04R 29/001* (2013.01); *H04R 29/004* (2013.01); *G10K 2210/1081* (2013.01); *H04R 2460/01* (2013.01)

(56) References Cited

U.S. PATENT DOCUMENTS

| | | | |
|---|---|---|---|
| 8,611,551 | B1 | 12/2013 | Massie |
| 8,718,291 | B2 | 5/2014 | Alves |
| 8,953,813 | B2 | 2/2015 | Loeda |
| 9,197,178 | B2 | 11/2015 | Ou |
| 9,247,337 | B2 | 1/2016 | Foudhaili |
| 9,386,386 | B2 | 7/2016 | Risberg |
| 9,659,558 | B2 | 5/2017 | Park |
| 9,837,066 | B2 | 12/2017 | Wurtz |
| 2010/0166206 | A1 | 7/2010 | Macours |
| 2011/0222696 | A1 | 9/2011 | Balachandran |
| 2013/0208908 | A1 | 8/2013 | Theiler |
| 2015/0092951 | A1 | 4/2015 | Ou |
| 2016/0063986 | A1 | 3/2016 | Ben-Ami |
| 2017/0195795 | A1 | 7/2017 | Mei |
| 2017/0245045 | A1 | 8/2017 | Horbach |
| 2018/0226064 | A1 | 8/2018 | Seagriff |
| 2019/0037324 | A1* | 1/2019 | Darlington ..... H04R 29/001 |

FOREIGN PATENT DOCUMENTS

| | | | |
|---|---|---|---|
| JP | 2015219527 | A | 12/2015 |
| WO | 2017129951 | | 8/2017 |
| WO | 2017182715 | A1 | 10/2017 |

* cited by examiner

300

AUTO CALIBRATION OF AN ACTIVE NOISE CONTROL SYSTEM

CROSS-REFERENCE TO RELATED APPLICATIONS

This application claims priority to U.S. Provisional Patent Application No. 62/713,643, filed Aug. 2, 2018 and United States Provisional Patent Application No. 62/857,751, filed Jun. 5, 2019, which is hereby incorporated by reference in its entirety.

TECHNICAL FIELD

This disclosure relates to processing audio data. In particular, this disclosure relates to calibrating a feedback-based Active Noise Control (ANC) system.

BACKGROUND

The use of audio devices such as headphones and earbuds (or in-ear headphones) has become extremely common. Such audio devices may be referred to herein as "ear devices." Some ear devices are capable of implementing a feedback-based ANC system. An ANC system may be capable of reducing unwanted sound, which may be referred to herein as a "disturbance," by adding a second sound that has been specifically designed to cancel the unwanted sound. The second sound may be an antiphase representation of the disturbance. Although currently-deployed ANC systems can provide satisfactory performance, it would be advantageous to provide audio devices having improved ANC systems.

SUMMARY

Some disclosed implementations involve methods for calibrating a feedback-based noise cancellation system of an ear device, such as an earbud or a headphone. Such calibration methods may, for example, be implemented as part of a process of manufacturing the ear device.

Some such implementations involve obtaining a measured plant response of the ear device. For example, such implementations may involve obtaining the measured plant response from a test fixture. The measured plant response may include a response of circuitry and acoustics of the ear device inclusive of a speaker driver and an ear device microphone. Some such examples may involve obtaining a reference plant response value. The reference plant response value may, for example, be based on the responses of multiple ear devices and may be obtained prior to the calibration of a particular ear device according to the methods disclosed herein. Such examples may involve determining a plant response variation between the reference plant response value and a value corresponding to the measured plant response.

Some such examples involve obtaining a measured coupler response of the ear device. The measured coupler response may include a response from the speaker driver to a test fixture microphone, including a response of circuitry and acoustics related to the speaker driver. Some such examples may involve obtaining a reference coupler response value. The reference coupler response value may be obtained prior to the calibration of a particular ear device according to the methods disclosed herein. Such examples may involve determining a coupler response variation between the reference coupler response value and a value corresponding to the measured coupler response.

Some implementations may involve determining, based at least in part on the plant response variation and the coupler response variation, a microphone signal gain correction factor to compensate for a variation of the microphone of the ear device. Some such implementations may involve applying the microphone signal gain correction factor to ear device microphone signals that are input to a feedback loop of the feedback-based noise cancellation system.

Some disclosed implementations have potential advantages. In some examples, one or more components of an ear device may have characteristics that vary, e.g., within a tolerance range. Such components may include speaker drivers and microphones. Taking the variations of such components into account on a per-unit basis can enhance the amount of ANC that an ear device provides. Some implementations may provide an automated process of calibrating a feedback-based noise cancellation system of an ear device, which takes into account the measured variations for each ear device. Some such implementations involve calibrating a feedback-based noise cancellation system of an ear device by taking into account measured frequency-dependent variations of components such as speaker drivers, microphones and/or other components of each ear device. Such implementations can provide advantages, as compared to calibration methods that involve adjusting an overall gain setting of a component that is constant over the entire frequency range in which the ANC is effective. Some such implementations may ensure that the ANC system operates within its specified operating tolerances and that these tolerances may be minimized or reduced.

Details of one or more implementations of the subject matter described in this specification are set forth in the accompanying drawings and the description below. Other features, aspects, and advantages will become apparent from the description, the drawings, and the claims. Note that the relative dimensions of the following figures may not be drawn to scale.

BRIEF DESCRIPTION OF THE DRAWINGS

Like reference numbers and designations in the various drawings indicate like elements.

DESCRIPTION OF EXAMPLE EMBODIMENTS

The following description is directed to certain implementations for the purposes of describing some innovative aspects of this disclosure, as well as examples of contexts in which these innovative aspects may be implemented. However, the teachings herein can be applied in various different ways. For example, while various implementations are described in terms of particular applications and environments, the teachings herein are widely applicable to other known applications and environments. Moreover, the described implementations may be implemented, at least in part, in various devices and systems as hardware, software, firmware, cloud-based systems, etc. Accordingly, the teachings of this disclosure are not intended to be limited to the implementations shown in the figures and/or described herein, but instead have wide applicability.

Various disclosed implementations involve active noise control (ANC) methods for ear devices such as headphones and earbuds. Some such methods are feedback-based digital ANC methods that are suitable for high-fidelity headphone and earbud applications. These devices incorporate a media audio input signal, which may be audio, speech, or a combination of the two.

Figure 1:
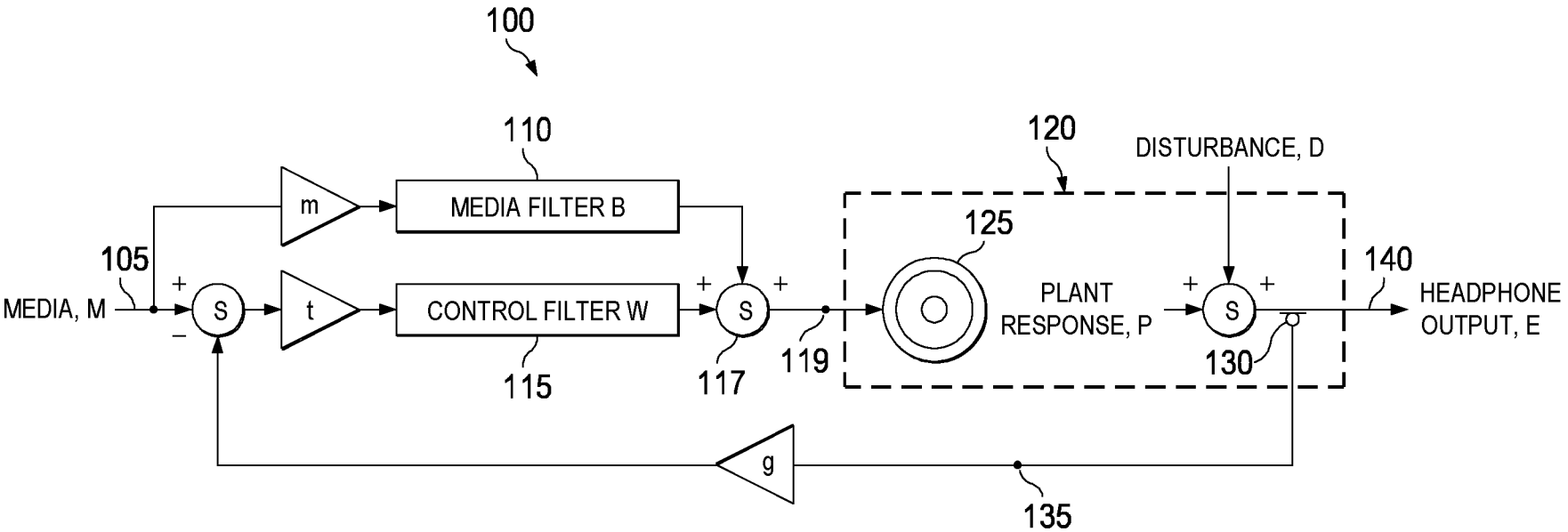
FIG. 1 shows blocks of an ANC system according to one example.

FIG. 1 shows blocks of an ANC system according to one example. According to some such implementations, the blocks of FIG. 1 may be implemented via a control system such as that described below with reference to FIG. 2. The control system may be, or may include, a control system of an ear device. For example, the blocks of FIG. 1 may be implemented on a digital integrated circuit that incorporates high-speed analog-to-digital (ADC), and digital-to-analog (DAC) converters specifically for the purpose of generating an ANC anti-phase signal, as well as the media output signal. However, in other instances the ANC methods disclosed herein may be implemented via other hardware and/or software. In this example, only the blocks of an ANC system 100 for a single instance of an ear device, such as a single headphone earcup or a single earbud, are shown in FIG. 1. According to this example, a corresponding instance of an ear device (e.g., the opposing earcup or the other ear bud) includes an identical ANC system 100.

The upper-case variables shown in FIG. 1 represent transfer functions for the block in which they appear, whereas lower-case variables represent wideband gain calibrating terms. The plant block 120 includes the driver 125 (which also may be referred to herein as a "speaker" or a "transducer") and the microphone 130, which is an internal microphone in this example. In this example the plant block 120 also includes associated circuitry that is not shown in FIG. 1, including a digital-to-analog converter (DAC) for the driver 125 and an analog-to-digital converter (ADC) for the microphone 130. Accordingly, the plant response P includes the response of the electro-acoustic path from the driver to the microphone, including the DAC and ADC.

The internal microphone 130 senses the acoustic pressure in the electro-acoustic path between the driver 125 and the ear of a person wearing the ear device. It is in this electro-acoustic path where the acoustic noise cancellation, for counteracting the disturbance d, is normally applied.

According to this implementation, the control filter 115 is configured for spectrally shaping the signals coming from the media input 105 and the feedback signal 135 that is provided by the internal microphone 130. The transfer function W for the control filter 115 provides this spectral shaping. In this example, the control filter 115 is a static (non-adaptive) control filter. However, in other embodiments the control filter 115 may be an adaptive control filter.

In this example, the ANC system 100 also includes a media filter 110 that takes as its input the media signal 105 and shunts its output to the summation block 117. In this example a gain m is provided to the media input 105 before the media input 105 is provided to the media filter 110. The transfer function B for the media filter 110 provides spectral shaping. The summation block 117 sums the outputs of the control filter 110 and the media filter 110 and provides the summation signal 119 to the driver 125.

There are two important figures of merit in this ANC system. The first is the rejection response, which is measured as the transfer function from the disturbance d to the output e, the latter of which is shown as element 140 in FIG. 1. The second is the media response, which is measured as the transfer function from the media input 105 to the output e.

For analysis of the first figure of merit, the system achieves acoustic cancellation by summing an antiphase representation of the disturbance (referred to in this case as d') from the driver, with the actual disturbance d from the environment. For sufficiently low frequencies, we can assume that d=d', but for higher frequencies this identity is not guaranteed. As such, feedback ANC systems such as this are bandlimited in terms of their ability to attenuate noise in the acoustic channel We define this upper limit of ANC cancellation to be the cancellation bandwidth, which we designate as $f_{BW}$. For frequencies above $f_{BW}$, passive isolation (such as can be provided by the padding of a high-quality headphone) can provide attenuation at these higher frequencies.

It is desirable to have a roughly uniform attenuation of environmental noise across frequencies, where for low frequencies (for example, for a $f_{BW}$ below 1 kHz) ANC can provide most of the attenuation, and for frequencies above $f_{BW}$, passive attenuation can provide the attenuation to external noise. Since the example shown in FIG. 1 is a feedback-based system, the signal 119 arriving over the feedback loop is ideally equal but opposite in phase below $f_{BW}$. The rejection response can be measured in terms of the log magnitude response, $20*\log_{10}(H_{rej}(j\omega))$ in decibels (dB). $H_{rej}$ may be defined as follows:

$$H_{rej} = \frac{e}{d} = \frac{1}{1 + gPW'} \qquad \text{Equation 1}$$

In Equation 1, g represents the gain that is applied to the signal 135 from the microphone 130 (as shown in FIG. 1) and P represents the transfer function for the plant block 120. The gain g may be thought of as the gain associated with compensating for variations in the sensitivity of the microphone 130. W' can be expressed as follows:

$$W' = tW \qquad \text{Equation 2}$$

In Equation 2, t represents the gain that is applied to the control filter 115 (as shown in FIG. 1). The gain t may be thought of as a control filter gain value to compensate for a variation of the speaker driver 125. W represents the transfer function for the control filter 115.

Because it would be preferable to maximize the amount of rejection, it would be desirable for the gain factor g to boost the open loop response PW' as much as practicable, in order to drive $H_{rej}$ toward maximum attenuation. One constraint, however, is that if for any complex frequency, $re\{gPW'\}=-1$ then the system will be unstable. In order to ensure stability for the complex frequency domain open loop response, it is important that $gPW'>-1.0+0j$, wherein $j=\sqrt{(-1)}$. We can analyze stability by performing a Nyquist analysis on the complex open loop response, in which we only need the control filter coefficients W' and a measure of the plant response P. W, the transfer function for the control filter 115, is preferably designed such that an antiphase signal is presented at the acoustic summing junction, after the driver 125. This may be realized by designing W towards the objective function PW=−1. Thus, W is ideally the magnitude inverse of P, but with a lowpass response applied in order to achieve loop closure above $f_{BW}$.

For analysis of the second figure of merit, which is the magnitude response applied specifically to the media path, one may represent the media response $H_m$ algebraically, e.g., as follows:

$$H_m = \frac{\text{ear}}{\text{media}} = H_{passthru} + H_{closed_loop} \quad \text{Equation 3}$$

$$H_m = \frac{mPB}{1 + gtPW} + \frac{tPW}{1 + gtPW} \quad \text{Equation 4}$$

In Equation 3, B represents the highpass filter responsible for the pass-through of media audio directly to the driver. $H_{passthru}$ represents the response along the path that includes the media filter 110 and the plant block 120, whereas $H_{closed_loop}$ represents the response along the path that includes the control filter 115 and the plant block 120. The combination of B and the ANC closed loop response $H_{closed_loop}$ provide the overall response applied to the media signal in this example.

Because in many instances the closed loop response portion of $H_m$ only works to cancel noise at low frequencies, according to some examples W, the transfer function for the control filter 115, may be designed to be lowpass in general. In such examples, $H_{closed_loop}$ would also be lowpass. Therefore, according to some such examples B may be designed to function as a complementary highpass to the lowpass $H_{closed_loop}$ response, such that $H_m$ has a roughly flat frequency response as applied to the media path signal. In some such implementations, any remaining non-flat features that one would desire to remove from the target response of the media path could be addressed by applying an additional up-stream filter only to the media path, where this upstream filter would compensate for the non-flat response in $H_m$.

Some novel aspects of this disclosure are related to the calculation of the gain values t, g and m of in FIG. 1. In the context of this specification, t, g and m are all based on logarithmic values. The logarithmic values of t may be converted to linear values by the equation $t_{lin}=10^{t/20}$, before being applied to the audio samples which they scale. The logarithmic values of gains g and m may be converted to linear values by corresponding equations.

The principal functions of the loop gains g and t are to (1) maximize cancellation performance while maintaining stability, and (2) compensate for variations of components across manufactured ear device units. The inventors have observed that such components can contribute to an overall variation in gain of as much as 6 dB in some examples. The inventors have determined that the two components with the greatest amount of variation that affect ANC are the driver 125 and the microphone 130. According to some disclosed implementations, the calibration procedure sets the gains g and t during the manufacturing process in order to compensate for the per-unit variations across ear devices (e.g., headphones).

According to some such examples, for each ear device on the manufacturing line at the time of calibration, the plant response p(n) is measured. As used herein, the term "plant response" refers to the response from the driver to the microphone, including the ADC, DAC and any additional ancillary circuitry in this path. In some such examples, the coupler response c(n) is also measured. As used herein, the term "coupler response" refers to the response from the driver (including the DAC) to a test fixture microphone. In some instances, the coupler response may be obtained by mounting an ear device on a test fixture, such as the test fixture described below. Because the test fixture microphones do not vary from ear unit to ear unit, the text fixture microphones act as reference points that one may use to calculate the gain values t, g and m. In some examples, the analysis may be performed in the frequency domain.

Figure 2:
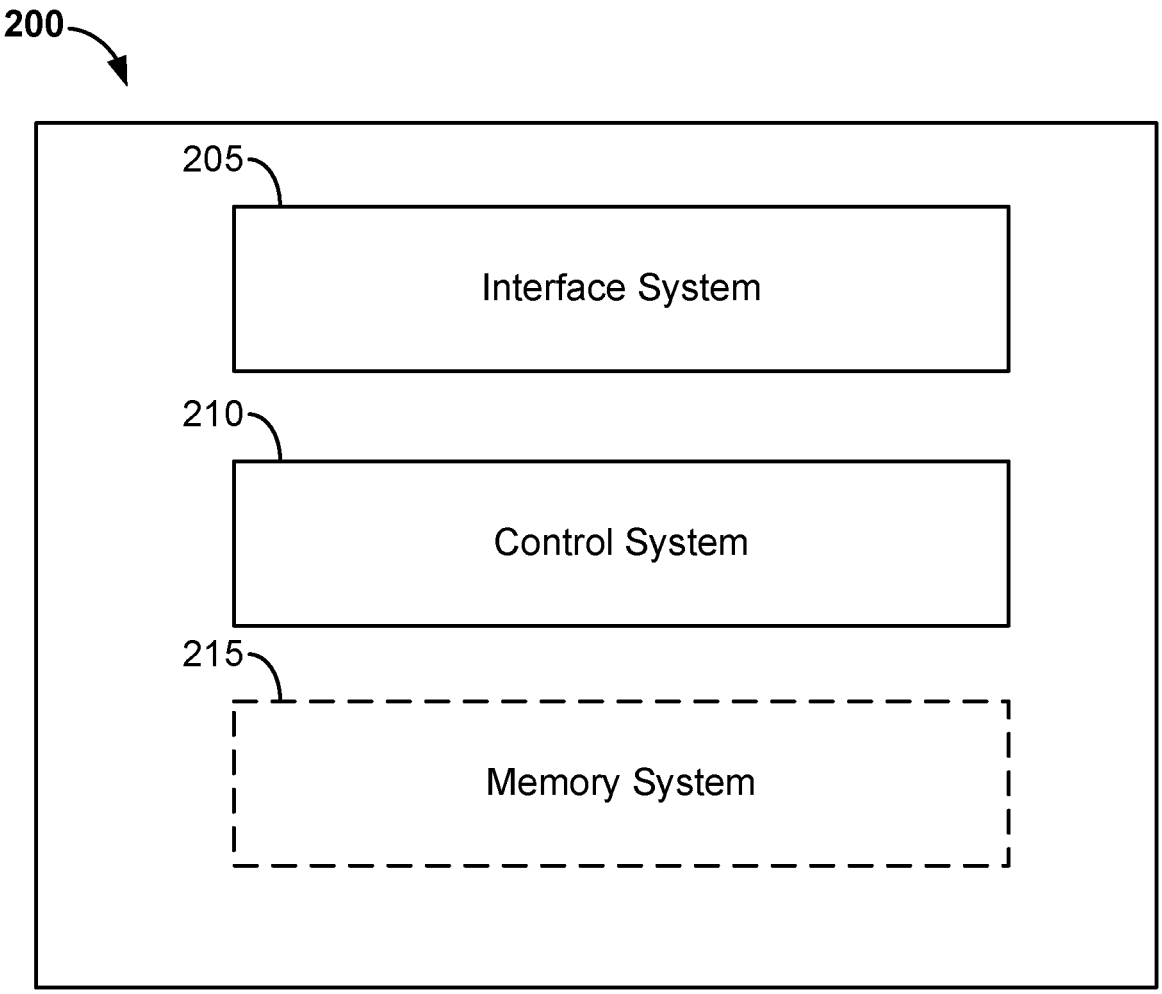
FIG. 2 is a block diagram that shows examples of components of an apparatus capable of implementing various aspects of this disclosure.

FIG. 2 is a block diagram that shows examples of components of an apparatus capable of implementing various aspects of this disclosure. In some implementations, the apparatus 200 may be, or may include, a computer used during a process of calibrating an ear device, e.g., during a manufacturing process. In this example, the apparatus 200 includes an interface system 205 and a control system 210. The interface system 205 may include one or more network interfaces and/or one or more external device interfaces (such as one or more universal serial bus (USB) interfaces). In some examples, the interface system 205 may include one or more interfaces between the control system 210 and a memory system, such as the optional memory system 215 shown in FIG. 2. However, the control system 210 may include a memory system.

The control system 210 may, for example, include a general purpose single- or multi-chip processor, a digital signal processor (DSP), an application specific integrated circuit (ASIC), a field programmable gate array (FPGA) or other programmable logic device, discrete gate or transistor logic, and/or discrete hardware components. In some implementations, the control system 210 may be capable of performing, at least in part, the methods disclosed herein.

Some or all of the methods described herein may be performed by one or more devices according to instructions (e.g., software) stored on one or more non-transitory media. Such non-transitory media may include memory devices such as those described herein, including but not limited to random access memory (RAM) devices, read-only memory (ROM) devices, etc. The one or more non-transitory media may, for example, reside in the optional memory system 215 shown in FIG. 2 and/or in the control system 210. Accordingly, various innovative aspects of the subject matter described in this disclosure can be implemented in one or more non-transitory media having software stored thereon. The software may, for example, include instructions for controlling at least one device to process audio data. The software may, for example, be executable by one or more components of a control system such as the control system 210 of FIG. 2.

Figure 3:
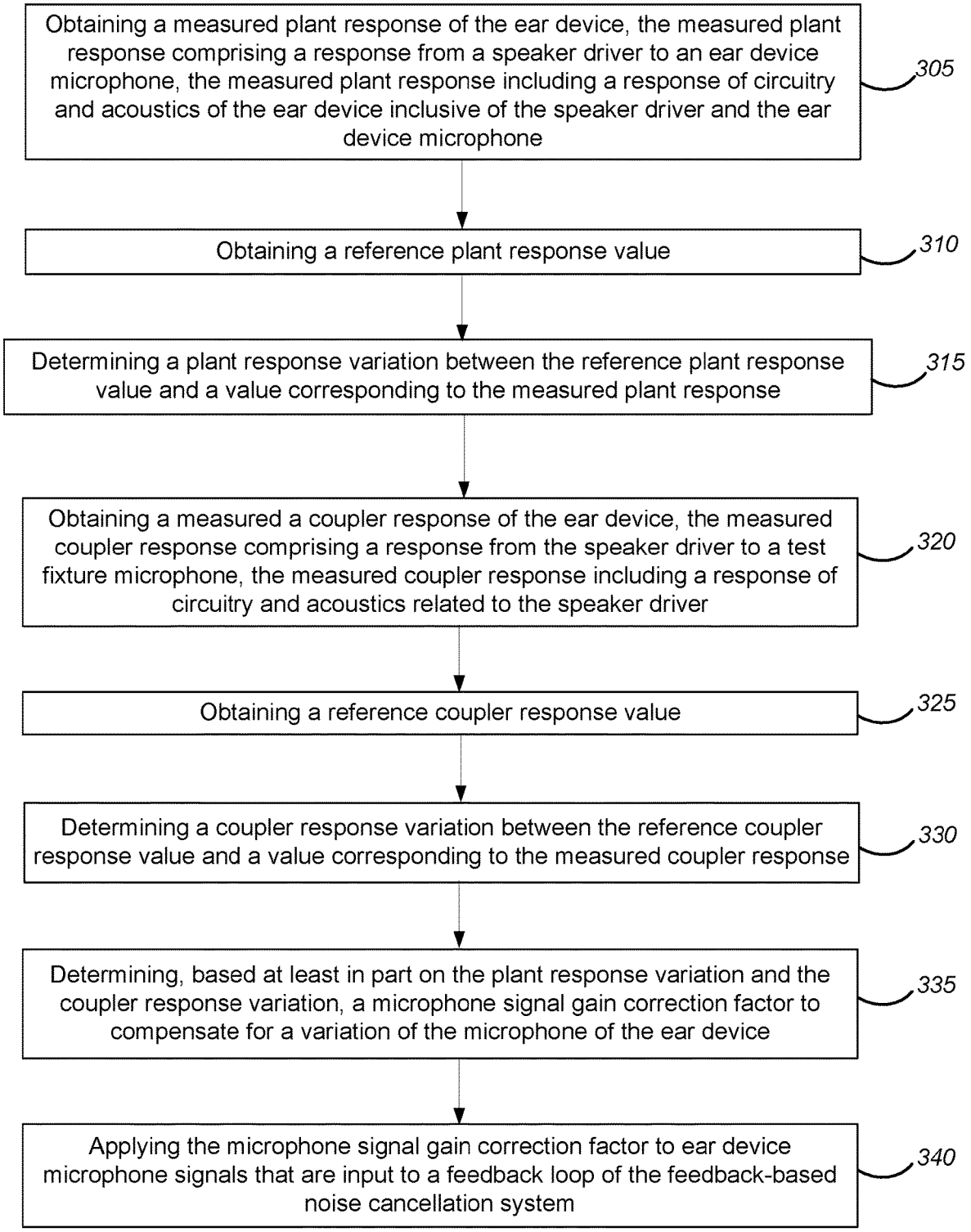
FIG. 3 is a flow diagram that outlines one example of a method that may be performed by an apparatus such as that shown in FIG. 2.

FIG. 3 is a flow diagram that outlines one example of a method that may be performed by an apparatus such as that shown in FIG. 2. The blocks of method 300, like other methods described herein, are not necessarily performed in the order indicated. Moreover, such methods may include more or fewer blocks than shown and/or described.

In this example, block 305 involves obtaining a measured plant response of an ear device. The ear device may, for example, be an earbud or a headphone. Here, the measured plant response includes a response from a speaker driver to an ear device microphone. The measured plant response may include a response of circuitry and acoustics of the ear device inclusive of the speaker driver and the ear device microphone. Block 305 may, for example, involve a control system (such as the control system 210 of FIG. 2) receiving the measured plant response via an interface system (such as the interface system 205 of FIG. 2). In some examples, block 305 may involve obtaining the measured plant response from a memory. In some instances, block 305 may involve obtaining the measured plant response from a test fixture microphone.

According to this example, block 310 involves obtaining (e.g., via the interface system) a reference plant response value. In some examples, block 310 may involve obtaining the reference plant response value from a memory. The reference plant response value may, for example, be a mean plant response value based upon measured plant responses for multiple ear devices. The mean plant response value may, in some instances, have been computed, or otherwise determined, prior to the processes of method 300.

In this implementation, block 315 involves determining (e.g., by a control system) a plant response variation between the reference plant response value and a value corresponding to the measured plant response. In some such examples, block 315 (or another part of method 300) may involve calculating a difference between the reference plant response value and a value corresponding to the measured plant response.

In some implementations, block 315 may involve performing a calculation in the frequency domain. In some such implementations, the value corresponding to the measured plant response may be a frequency domain representation of a plant response measured in the time domain. For example, the value corresponding to the measured plant response may be a Fourier transform of the plant response p(n) referenced above.

According to this example, block 320 involves obtaining a measured coupler response of the ear device. The measured coupler response may include a response from the speaker driver to a test fixture microphone. Accordingly, the measured coupler response may include a response of circuitry and acoustics related to the speaker driver. In some examples, block 320 may involve obtaining the measured coupler response from a memory, whereas in some instances block 320 may involve obtaining the measured coupler response from the test fixture microphone.

In this implementation, block 325 involves obtaining a reference coupler response value. In some examples, block 325 may involve obtaining the reference coupler response value from a memory. The reference plant response value may, for example, be a mean reference coupler response value based upon measured coupler responses for multiple ear devices. The mean coupler response value may, in some instances, have been computed, or otherwise determined, prior to the processes of method 300.

According to this implementation, block 330 involves determining (e.g., by a control system) a coupler response variation between the reference coupler response value and a value corresponding to the measured coupler response. In some such examples, block 330 (or another part of method 300) may involve calculating a difference between the reference coupler response value and a value corresponding to the measured coupler response. In some implementations, block 330 may involve performing a calculation in the frequency domain. In some such implementations, the value corresponding to the measured coupler response may be a frequency domain representation of a coupler response measured in the time domain. For example, the value corresponding to the measured coupler response may be a Fourier transform of the coupler response c(n) that is referenced above.

According to this example, block 335 involves determining, based at least in part on the plant response variation and the coupler response variation, a microphone signal gain correction factor to compensate for a variation of the microphone of the ear device. Some examples are provided below. In this disclosure, the gain correction factor to be applied as a result of the variation in the microphone of the ear device being calibrated may be referred to as g(i), or simply as g. In this implementation block 340 involves applying the microphone signal gain correction factor to ear device microphone signals that are input to a feedback loop of the feedback-based noise cancellation system.

In some examples, the method 300 may involve determining, based at least in part on the value corresponding to the plant response and the microphone signal gain correction factor, a control filter gain value. The control filter gain value may be referred to herein as t(i), or simply as t. Some such methods may involve applying the control filter gain value to audio signals input into a control filter of the feedback-based noise cancellation system.

In some disclosed methods, determining the control filter gain value may involve determining a curve fit for a plurality of data points corresponding to plant responses and feedback loop gain values for a plurality of ear devices. In some instance, the curve fit may be a linear curve fit. For example, determining the control filter gain value may involve multiplying the value corresponding to the plant response by a scale factor and adding a bias value. The scale factor may correspond to a slope of a line corresponding to the linear curve fit. The bias value may correspond to a y intercept of the line.

Figure 4:
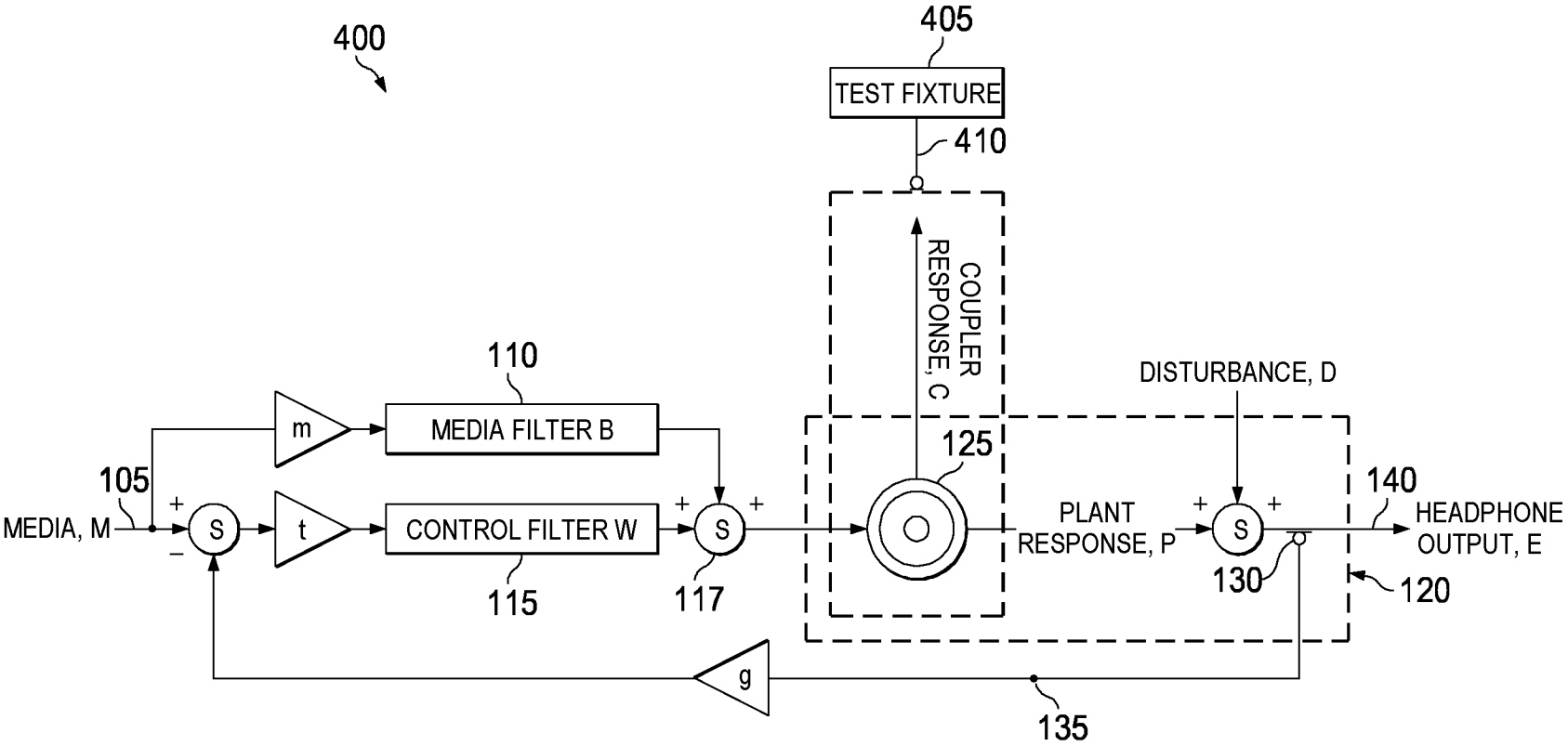
FIG. 4 shows blocks of an ANC system and a test fixture according to one example.

FIG. 4 shows blocks of an ANC system and a test fixture according to one example. In this example, system 400 of FIG. 4 includes the same elements that are shown in FIG. 1, with the addition of a test fixture 405. Here, the test fixture 405 includes a test fixture microphone 410. Accordingly, FIG. 4 provides an example of a system that may be used to determine a measured coupler response c(n) of an ear device. In this example, the measured coupler response c(n) includes a response from the speaker driver 125 to the test fixture microphone 410, including a response of circuitry and acoustics related to the speaker driver 125. In some examples, the above-referenced value corresponding to the measured coupler response may be a Fourier transform of the measured coupler response c, e.g., as follows:

$$C=\mathrm{FFT}\{c\} \qquad \text{Equation 4}$$

In Equation 4, C represents the coupler response shown in FIGS. 1 and 4. Similarly, the above-referenced value corresponding to the measured plant response may be a Fourier transform of the measured plant response p, e.g., as follows:

$$P=\mathrm{FFT}\{p\} \qquad \text{Equation 5}$$

In Equation 5, P represents the plant response shown in FIGS. 1 and 4. In this example, both p and c are time domain impulse response waveforms with minimum-phase characteristics.

Figure 5:
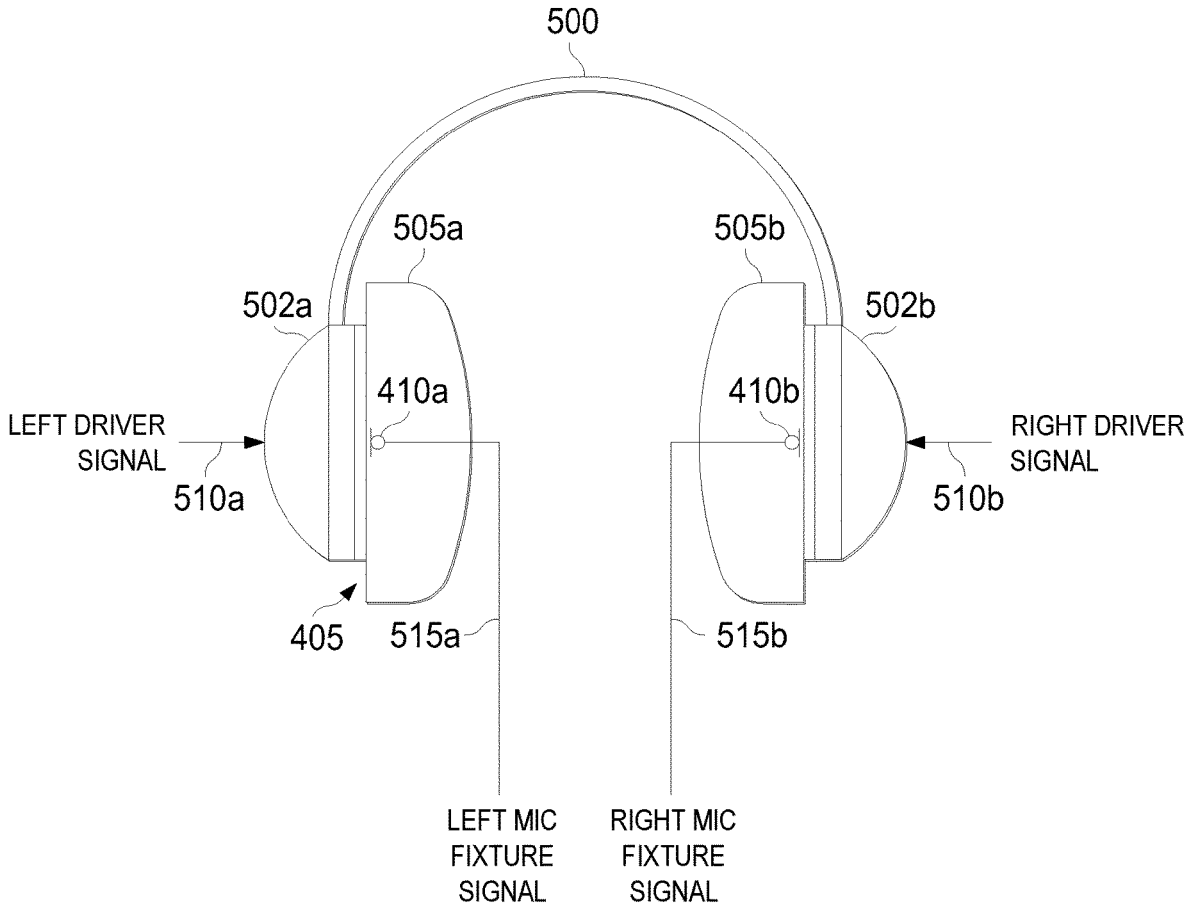
FIG. 5 shows an example of an ear device mounted on a text fixture.

FIG. 5 shows an example of an ear device mounted on a text fixture. In this example, the ear device 500 is a headphone. In the example shown in FIG. 5, the earcup 502*a* is positioned on mount 505*a* of the test fixture 405 and the earcup 502*b* is positioned on mount 505*b* of the test fixture 405. Mounts 505*a* and 505*b* may be designed to minimize acoustic leakage around the perimeters of the areas in which the earcups 502*a* and 502*b* are mounted on the test fixture 405. In this example, the headphone 500 is padded so as to reduce leakage between the headphone 500 and the test fixture 405. According to this implementations, the test fixture 405 has microphones for each earcup: the mount 505*a* includes a microphone 410*a* and the mount 505*b* includes a microphone 410*b*. In this example, the microphone 410*a* is shown transmitting a left microphone fixture signal 515*a* and the microphone 410*b* is shown transmitting a right microphone fixture signal 515*b*. Accordingly, the microphones 410*a* and 410*b* may be used to acquire the above-referenced coupler response c.

As noted above, in some examples the reference plant response value may be a mean plant response value based upon measured plant responses (e.g., plant responses measured by a test fixture such as the test fixture 405) for multiple ear devices. According to some such examples, the reference plant response value may be determined as follows:

$$p_{mean} = \frac{\sum_{i=0}^{Nunits} \sum_{k=lowFreq}^{hiFreq} 20\log|P(i,k)|}{Nunits \cdot (hiFreq - lowFreq)} \quad \text{Equation 6}$$

In Equation 6, $P_{mean}$ represents a mean plant response value, $N_{units}$ represents a number of units of ear devices being considered in computing the mean, k represents frequency and hiFreq and lowFreq refer to the frequency range limits considered in computing the mean. The values of hiFreq and lowFreq will generally be in a frequency range below $f_{BW}$ and may be set according to a number of different factors, such as the peak response in P, the minimum (or maximum) variation across units and/or the region(s) (e.g., the frequency band(s)) of maximum noise cancellation. In one embodiment lowFreq is 500 Hz and hiFreq is 1000 Hz. However, these are merely examples. In other implementations, lowFreq and/or hiFreq may have different values.

According to some such examples, the reference coupler response value may be determined in a similar manner, e.g., as follows:

$$C_{mean} = \frac{\sum_{i=0}^{Nunits} \sum_{k=lowFreq}^{hiFreq} 20\log|C(i,k)|}{Nunits \cdot (hiFreq - lowFreq)} \quad \text{Equation 7}$$

In Equation 7, $C_{mean}$ represents a mean coupler response value. The calculation of $P_{mean}$ and $C_{mean}$ is preferably done prior to the beginning of a calibration process as disclosed herein. The values of $P_{mean}$ and $C_{mean}$ may be stored to a computer file or memory location, to be read during the calibration procedure.

As mentioned above, in some implementations the test fixture microphones do not vary across the individual units of ear devices that are being calibrated. Therefore, one can use this invariant information to separate how much of the variation in the plant response is due to characteristics of the internal microphone of the ear device being calibrated, which can be addressed according to the value of g in some implementations, and how much is due to characteristics of the driver of the ear device being calibrated, which can be addressed according to the value of t in some implementations. Because in some such examples the coupler response varies only as a function of the variation in the driver, in some implementations the variation from the mean of the coupler and plant energy between hiFreq and lowFreq may first be calculated, e.g., as follows:

$$C(i)_v = C_{range}(i) - C_{mean} \quad \text{Equation 8}$$

$$P(i)_v = P_{range}(i) - P_{mean} \quad \text{Equation 9}$$

In Equations 8 and 9, $C_{mean}$ and $P_{mean}$ may be determined according to Equations 6 and 7, and the index i represents the unit index for the headphone (or other ear device) that is currently being calibrated. Accordingly, in Equation 8 C(i) represents the variation from the mean ($C_{mean}$) for the headphone (or other ear device) that is currently being calibrated, of the level measured at the test fixture. Similarly, in Equation 9, P(i) represents the variation from the mean ($P_{mean}$) for the headphone (or other ear device) that is currently being calibrated, of the level at the microphone.

In some examples, $C_{range}(i)$ in Equation 8 may be determined as follows:

$$C_{range} = \frac{\sum_{k=lowFreq}^{hiFreq} 20\log|C(i,k)|}{hiFreq - lowFreq} \quad \text{Equation 10}$$

In some implementations, $P_{range}(i)$ in Equation 9 may be determined as follows:

$$P_{range} = \frac{\sum_{k=lowFreq}^{hiFreq} 20\log|P(i,k)|}{hiFreq - lowFreq} \quad \text{Equation 11}$$

According to some such implementations, after determining $C(i)_v$ and $P(i)_v$, the gain correction factor g(i) to be applied as a result of the variation in the microphone of the ear device being calibrated may be determined as follows:

$$g(i) = C(i)_v - P(i)_v \quad \text{Equation 12}$$

In some such implementations, after determining the gain correction factor g(i), the gain correction factor t(i) to be applied as a result of the variation in the driver of the ear device being calibrated may be determined according to curve fit of a plurality of data points corresponding to plant responses and feedback loop gain values for a plurality of ear devices. In one such example, the gain correction factor t(i) may be determined according to a linear curve fit of such data points, e.g., as follows:

$$t(i) = \text{Bias} + \text{Scale} \cdot P(i) - g(i) \quad \text{Equation 13}$$

Equation 13 is in the form of y=b+mx, the equation for a straight line having a slope of m and a y intercept of b. Accordingly, in Equation 13 Bias represents a bias value corresponding to the y intercept of the line and Scale represents the slope of the line. Accordingly, in this example Bias and Scale were calculated based on a population of ear devices to result in a target desired loop gain across all units. Equation 13 represents a means of controlling the tradeoff between cancellation performance and stability, globally across all manufactured units.

In some implementations, similar calculations may be performed for setting m, the desired gain of the media path filter B. However, in this case the frequency range will generally be above $f_{BW}$ and may cover a wider frequency range. Accordingly, the measured plant responses, the reference plant response values, the measured coupler responses and the reference coupler response values referenced above are all determined for a first frequency range of the feedback-based noise cancellation system. The first frequency range may correspond to a cancellation bandwidth of the feedback-based noise cancellation system. Some disclosed methods involve determining a higher-frequency plant response for a second frequency range that is above the first frequency range.

Some such methods may involve obtaining a reference higher-frequency plant response value and determining a higher-frequency plant response variation between the higher-frequency reference plant response value and a value corresponding to the higher-frequency plant response. Such methods may involve determining, based on the higher-frequency plant response variation, a media path gain value for a media path of the feedback-based noise cancellation system.

According to some such examples $P_{HF_mean}$, the reference plant response value for this higher frequency range, may be determined as follows:

$$P_{HF_mean} = \frac{\sum_{i=0}^{Nunits} \sum_{k=mLowFreq}^{mHiFreq} 20\log|P(i,k)|}{Nunits \cdot (mHiFreq - mLowFreq)} \quad \text{Equation 14}$$

One may observe that Equation 14 parallels Equation 6. The process of obtaining $P_{HF_mean}$ may parallel that described above with reference to Equation 6. However, in Equation 14 mHiFreq and mLowFreq represent the high and low frequencies of a frequency range above $f_{BW}$. In some implementations, mHiFreq and mLowFreq may be much higher than the above-described hiFreq and lowFreq. For example, mHiFreq and mLowFreq may be in the kHz range. In one embodiment mLowFreq may be 5 kHz and mHiFreq may be 10 kHz. However, these are merely examples. In other implementations, mLowFreq and/or mHiFreq may have different values.

In some examples $P_{HF}(i)$, the plant response value for a particular unit in this higher frequency range, may be determined as follows:

$$P_{HF}(i) = \frac{\sum_{k=mLowFreq}^{mHiFreq} 20\log|P(i,k)|}{mHiFreq - mLowFreq} \quad \text{Equation 15}$$

One may observe that Equation 15 parallels Equation 11. In some such implementations $P(i)_{HF_v}$, the variation from the mean of the plant energy in this higher frequency range, may be determined as follows:

$$P(i)_{HF_v} = P_{HF}(i) - P_{HF_mean} \quad \text{Equation 16}$$

According to some such examples m(i), the desired gain of the media path filter B, may be determined as follows:

$$m(i) = P(i)_{HF_v} \quad \text{Equation 17}$$

One will note that in this example the coupler response does not come into play in computing m(i), because mHiFreq and mLowFreq are assumed to be well above $f_{BW}$. Setting g, t and m according to the above-described methods can ensure that the ANC system operates within its specified operating tolerances and that these tolerances may be minimized or reduced.

Various modifications to the implementations described in this disclosure may be readily apparent to those having ordinary skill in the art. The general principles defined herein may be applied to other implementations without departing from the scope of this disclosure. Thus, the claims are not intended to be limited to the implementations shown herein, but are to be accorded the widest scope consistent with this disclosure, the principles and the novel features disclosed herein.

What is claimed is:

1. A method of calibrating a feedback-based noise cancellation system of an ear device having a speaker driver and an internal microphone for sensing the acoustic pressure in the electro-acoustic path between the speaker driver and the ear of a person wearing the ear device, the noise cancellation system comprising:

a feedback loop;

a control filter for spectrally shaping an input audio signal of the ear device and a feedback signal from the internal microphone, that is input to the feedback loop;

a media filter for spectrally shaping the input audio signal of the ear device; and a summation block for summing the outputs of the control filter and the media filter and providing the summation signal to the speaker driver, the method comprising:

obtaining a measured plant response P of the ear device, the measured plant response P comprising a response from the speaker driver to the internal microphone, the measured plant response P including a response of circuitry and acoustics of the ear device inclusive of the speaker driver and the internal microphone;

obtaining a reference plant response value;

determining a plant response variation between the reference plant response value and a value corresponding to the measured plant response P;

obtaining a measured coupler response of the ear device, the measured coupler response comprising a response from the speaker driver to a test fixture microphone, the measured coupler response including a response of circuitry and acoustics related to the speaker driver;

obtaining a reference coupler response value;

determining a coupler response variation between the reference coupler response value and a value corresponding to the measured coupler response;

determining, based at least in part on the plant response variation and the coupler response variation, a microphone signal gain correction factor g;

setting the microphone signal gain correction factor g as the gain to be applied to signals from the internal microphone, that are input to the feedback loop;

determining, based at least in part on the value corresponding to the measured plant response P and the microphone signal gain correction factor g, a control filter gain value t to compensate for a variation of the speaker driver, and setting the control filter gain value t as the gain to be applied to an audio signal input into the control filter.

2. The method of claim 1, wherein determining the control filter gain value involves multiplying the value corresponding to the measured plant response by a scale factor and adding a bias value.

3. The method of claim 2, wherein the scale factor corresponds to a slope of a linear curve fit of a plurality of data points corresponding to plant responses and feedback loop gain values for a plurality of ear devices.

4. The method of claim 1, wherein the measured plant response P, the reference plant response value, the measured coupler response and the reference coupler response value are all determined for a first frequency range of the feedback-based noise cancellation system, the method further comprising:

obtaining a measured plant response PHF for a second frequency range of the noise cancellation system;

obtaining a reference plant response value for the second frequency range;

determining a plant response variation for the second frequency range, between the reference plant response value for the second frequency range and a value corresponding to the measured plant response PHF for the second frequency range;

determining, based on the plant response variation for the second frequency range, a media path gain value m; and setting the media path gain value m as the gain to be applied to an audio signal input into the media filter, wherein the second frequency range is above the first frequency range.

5. The method of claim 4, wherein an upper limit of the first frequency range corresponds to the cancellation bandwidth of the feedback-based noise cancellation system.

6. The method of claim 1, wherein the reference plant response value comprises a mean plant response value based upon measured plant responses for multiple ear devices, wherein the reference coupler response value comprises a mean coupler response value based upon measured coupler responses for multiple ear devices.

7. The method of claim 1, wherein the value corresponding to the measured plant response P is determined as a frequency transform of an impulse response measured in the time domain and wherein the value corresponding to the measured coupler response is determined as a frequency transform of an impulse response measured in the time domain.

8. The method of claim 1, wherein the ear device comprises an earbud or a headphone.

9. The method of claim 1, wherein circuitry related to the speaker driver includes a digital-to-analog converter for the speaker driver, and circuitry related the microphone includes an analog-to-digital converter for the microphone.

10. A system for calibrating a feedback-based noise cancellation system of an ear device, configured to perform the method of claim 1.

11. One or more non-transitory media having software stored thereon, the software including instructions for controlling one or more devices to perform a method according to of claim 1.

* * * * *